US008797246B2

(12) United States Patent
Abe

(10) Patent No.: US 8,797,246 B2
(45) Date of Patent: Aug. 5, 2014

(54) DRIVING CIRCUIT AND VOLTAGE GENERATING CIRCUIT AND DISPLAY UNIT USING THE SAME

(75) Inventor: Katsumi Abe, Tokyo (JP)

(73) Assignee: Gold Charm Limited, Apia (WS)

( * ) Notice: Subject to any disclaimer, the term of this patent is extended or adjusted under 35 U.S.C. 154(b) by 44 days.

(21) Appl. No.: 13/396,180

(22) Filed: Feb. 14, 2012

(65) Prior Publication Data

US 2012/0212471 A1 Aug. 23, 2012

Related U.S. Application Data

(62) Division of application No. 10/664,969, filed on Sep. 22, 2003, now abandoned.

(30) Foreign Application Priority Data

Sep. 25, 2002 (JP) ..... 2002-278274

(51) Int. Cl.
*G09G 3/36* (2006.01)

(52) U.S. Cl.
USPC ..... 345/87

(58) Field of Classification Search
USPC ..... 345/87
See application file for complete search history.

(56) References Cited

U.S. PATENT DOCUMENTS 4,393,380 A 7/1983 Hosokawa et al.
5,774,099 A * 6/1998 Iwasaki et al. ..... 345/87
5,793,680 A 8/1998 Okajima
6,329,845 B1 12/2001 Taki
6,633,287 B1 10/2003 Yatabe et al.
7,002,541 B2 2/2006 Yanagi et al.
7,098,885 B2 8/2006 Kumada et al.
7,133,034 B2 11/2006 Park et al.
2002/0000833 A1 1/2002 Taki
2002/0008686 A1 1/2002 Kumada et al.

(Continued)

FOREIGN PATENT DOCUMENTS

CN 1253303 A 5/2000
EP 0 772 067 A1 5/1997

(Continued)

OTHER PUBLICATIONS

Dorf, Richard C., "The Electrical Engineering Handbook," 2000, CRC Press LLC, USA.

(Continued)

*Primary Examiner* — Jonathan Horner
(74) *Attorney, Agent, or Firm* — Novak Druce Connolly Bove + Quigg LLP

(57) ABSTRACT

A liquid crystal display substrate has a data driver circuit and a gate driver circuit for driving the liquid crystal display integrated thereon together with a common drive circuit, where common voltages VCOMH and VCOML are applied from the outside through a pad. The gate driver circuit is placed to be adjacent to one of the four terminals of the liquid crystal display. The common drive circuit is placed to be adjacent to the terminal opposite to where the gate driver circuit is placed and as close to the pad as possible while having almost the same width as the area of the gate driver circuit. The pad close to where the common drive circuit is placed is used as the pad for applying the common voltages VCOMH and VCOML.

12 Claims, 10 Drawing Sheets

(56) References Cited

U.S. PATENT DOCUMENTS

| | | | |
|---|---|---|---|
| 2002/0018059 | A1 | 2/2002 | Yanagi et al. |
| 2002/0075249 | A1 | 6/2002 | Kubota et al. |
| 2002/0101415 | A1 | 8/2002 | Song |
| 2002/0180720 | A1 | 12/2002 | Ishiyama |

FOREIGN PATENT DOCUMENTS

| | | | |
|---|---|---|---|
| EP | 1 195 741 | A2 | 4/2002 |
| JP | 11-194316 | A | 7/1999 |
| JP | 11-194320 | A | 7/1999 |
| JP | 2002-174823 | A | 6/2002 |

OTHER PUBLICATIONS

Mikami, Y., et al., "A 5-in. SVGA TFT-LCD with Integrated Multiple DAC Using Low-Temperature poly-Si TFTs," Asia Display/IDW 01 Proceedings, Oct. 16, 2001, pp. 1607-1610 with Abstract.

Nakamura, Takashi, et al., "L w Temperature Poly-Si TFT-LCD with Integrated Analog Circuit," Asia Display/IDW 01 Proceedings, Oct. 16, 2001, pp. 1603-1606 with Abstract.

* cited by examiner

DRIVING CIRCUIT AND VOLTAGE GENERATING CIRCUIT AND DISPLAY UNIT USING THE SAME

CROSS REFERENCE TO RELATED APPLICATIONS

This application is a divisional of U.S. patent application Ser. No. 10/664,969, filed Sep. 22, 2003, claiming priority based on Japanese Patent Application No. 2002-278274, filed Sep. 25, 2002, the contents of all of which are incorporated herein by reference in their entirety.

DETAILED DESCRIPTION OF THE INVENTION

1. Field of the Invention

The present invention relates to a drive circuit and a voltage generating circuit for a display unit and the display unit using the same, and in particular, to circuits and arrangement thereof in integrating a load drive circuit and the voltage generating circuit on the same substrate as that of a display portion.

2. Prior Art

A liquid crystal display is used in various fields for its advantages such as lightweight, low profile and low power consumption compared to a CRT (Cathode Ray Tube).

Of the liquid crystal displays, as shown in FIG. 9, an active matrix liquid crystal display has a liquid crystal display portion 11 in which pixels having amorphous silicon (a-Si) thin-film transistors (TFT) as switching elements are arranged in a matrix on a glass substrate.

This liquid crystal display is externally equipped with data driver ICs (integrated circuits) 21-1 to 21-5 for driving data lines, gate driver ICs 31-1 to 31-8 for controlling switching of pixels of each line, a common drive circuit IC 40 for driving a common electrode opposed to a picture electrode by sandwiching a liquid crystal layer, and a power circuit IC 50 for providing a voltage to driver circuits and drive circuits.

If the voltage applied to the liquid crystal layer is constantly unipolar, the liquid crystal display is subject to DC components applied to the liquid crystal layer for a long time, causing problems such as degradation of liquid crystal characteristics. For this reason, a frame inversion drive for inverting a polarity of the voltage applied to the liquid crystal layer for each frame or a line inversion drive for inverting it for each line have been implemented (refer to patent documents 1 and 2 for instance).

In recent years, it is possible to fabricate not only pixel switching elements but also various circuits on the glass substrate with the advance of the polysilicon (p-Si) TFT technology having higher current capability than a-Si (refer to non-patent documents 1 and 2 for instance).

In the liquid crystal display used for a cell-phone unit in a several-inch class of which load to be driven is several pF or so, for example, a data driver circuit 22 and gate drivers 32-1 and 32-2 are mounted on the same substrate 10 as that of the pixels in the liquid crystal display as shown in FIG. 10. Thus, it is possible to reduce the number of parts and connections required for the liquid crystal display so as to reduce the costs and provide high reliability.

The common drive circuit IC 40 for performing the line inversion drive drives the common electrode at an H level (VCOMH) and an L level (VCOML) in each horizontal period. In this case, simultaneously driving the common electrodes of all the pixels in the liquid crystal display, the common drive circuit IC 40 needs to drive a large load of several nF or more at a high speed of several μs.

For that reason, a bipolar transistor with high current capability or a single-crystal Si MOSFET (Metal-Oxide-Semiconductor Field-Effect Transistor) with several-mm gate width have conventionally been used in an output stage of the common drive circuit IC 40.

If the common drive circuit IC 40 as described above could be configured using a p-Si TFT and mounted on the same substrate 10 as that of the pixels in the liquid crystal display, it would be provide the same advantages as in the case of mounting the data drivers and gate drivers.

To mount the common drive circuit IC 40, however, the TFT of which gate width is 10 mm or so are necessary in the output stage of the common drive circuit IC 40 because the current capability of the p-Si TFT is on the order of 1/10 of the Si MOSFET.

Furthermore, it is also necessary to consider influence of wiring resistance on a driving speed. Therefore, to fabricate the common drive circuit IC 40 on the same substrate 10 as that of the pixels in the liquid crystal display, a large area for placing the common drive circuit IC 40 must be saved in a hidden area, making it difficult to make the frame narrower.

Although a symmetrical frame design is required for the entire liquid crystal display including the drive circuit, it is not easy to make the frame symmetrical in arranging the common drive circuit IC 40.

Patent Document 1

Japanese Patent Laid-Open No. 11-194320 (pp. 3 to 5, FIG. 1)

Patent Document 2

Japanese Patent Laid-Open No. 11-194316 (pp. 3 to 7, FIG. 1)

Non-Patent Document 1

"Low Temperature Poly-Si TFT-LCD with Integrated Analog Circuit" (T. Nakamura, et al., Asia Display/IDW' 01 Proceedings, Oct. 16, 2001, pp. 1603-1606m, FIG. 1)

Non-Patent Document 2

"A 5-in, SVGA TFT-LCD with Integrated Multiple DAC Using Low-Temperature poly-Si TFTs" (Y. Mikami, et al., Asia Display/IDW' 01 Proceedings, Oct. 16, 2001, pp. 1607-1610, FIG. 1)

Problems to be Solved by the Invention

In the conventional liquid crystal display as described above, there is a problem that the common drive circuit using the TFT requires larger area because the TFT has lower current capability than the bipolar transistor and single-crystal Si MOSFET.

In the conventional liquid crystal display, there is also a problem that the common drive circuit has large circuit area and is easily influenced by wiring resistance, and requires a wide and asymmetrical frame in order to place the common drive circuit using the TFT on the same substrate as that of the pixels in the liquid crystal display.

Thus, an object of the present invention is to provide a drive circuit and a voltage generating circuit for a display unit and the display unit using the same that have solved the above problems and provide a symmetrical and/or narrow frame and without lowering drive capability of the common drive circuit.

Means for Solving the Problems

The drive circuit for the display unit according to the present invention is the one for simultaneously driving capacitive loads in the display unit at least having a gate driver circuit for controlling switching of pixels of each line in a display portion integrated on the same substrate as the above described substrate having the above described display portion mounted thereon, and is placed at a position opposed to the above described gate driver circuit by sandwiching the above described display portion.

The voltage generating circuit according to the present invention is the one for generating a service voltage to the drive circuit for the display unit for simultaneously driving the capacitive loads in the display unit at least having the gate driver circuit for controlling the switching of the pixels of each line of the display portion integrated on the same substrate as the substrate having the above described display portion mounted thereon, and is placed together with the above described drive circuit for the display unit at a position opposed to the above described gate driver circuit by sandwiching the above described display portion.

The display unit according to the present invention is the one at least having the gate driver circuit for controlling the switching of the pixels of each line of the display portion integrated on the same substrate as the substrate having the above described display portion mounted thereon, and has the drive circuit for the display unit for simultaneously driving the capacitive loads in the above described display unit placed at a position opposed to the above described gate driver circuit by sandwiching the above described display portion.

The other display unit according to the present invention is the one at least having the gate driver circuit for controlling the switching of the pixels of each line of the display portion integrated on the same substrate as the substrate having the above described display portion mounted thereon, and has the drive circuit for the display unit for simultaneously driving the capacitive loads in the above described display portion and the voltage generating circuit for generating the service voltage to the above described drive circuit for the display unit placed at a position opposed to the above described gate driver circuit by sandwiching the above described display portion.

To be more specific, the drive circuit for the display unit according to the present invention has the common drive circuit constituted to provide a voltage to a common electrode from two common level power lines (VCOMH and VCOML) by means of a switch TFT integrated on the same substrate as the substrate having the display portion placed like a matrix mounted thereon.

The drive circuit for the display unit according to the present invention also has an H level of a common inversion timing signal to be inputted to a gate of the switch TFT set higher than a common voltage VCOMH and an L level thereof lower than a common voltage VCOML so as to set a gate length of the TFT according to two common level power amplitudes.

In the case where a gate driver exists on the same substrate as that of the pixels in the liquid crystal display, the common drive circuit is placed at the terminal opposite to the terminal at which the gate driver is placed and as close to a pad as possible. In addition, the pads having the common drive circuit placed nearby are used as two common level pads. In the case where a power circuit (common voltage generating circuit) is placed on the same substrate, however, the common drive circuit is placed close to the common voltage generating circuit.

The common voltage (VCOMH and VCOML) generating circuit suited to the common drive circuit and capable of easily adjusting a common voltage level is comprised of a variable resistance (VR1) for adjusting a voltage difference between the common voltages VCOMH and VCOML, a variable resistance (VR2) for adjusting the level of the common voltage VCOML, four resistances (R11, R12, R21 and R22), two operational amplifiers (A1 and A2) and two capacities (C1 and C2), and has adequate constant voltage (Vref) inputted thereto. However, a total resistance value of the variable resistance VR1 is one third or less compared to the resistance R11. Here, capacity values of the two capacities C1 and C2 are sufficiently larger (100 times or more) than a total of common electrode capacities of the liquid crystal display.

An inversion input terminal of an operational amplifier A1 has the resistances R11 and R12 connected in parallel thereto, where the other terminal of the resistance R11 is connected to a variable portion of the variable resistance VR1 and the other terminal of the resistance R12 is connected to output of the operational amplifier A1 respectively. A non-inversion input terminal of the operational amplifier A1 is connected to the variable portion of the variable resistance VR2. Furthermore, the capacity C1 is connected to the output of the operational amplifier A1. This output outputs the H-level common voltage VCOMH.

The inversion input terminal of an operational amplifier A2 has the resistances R21 and R22 connected in parallel thereto, where the other terminal of the resistance R21 is connected to the constant voltage Vref and the other terminal of the resistance R22 is connected to the output of the operational amplifier A2 respectively. The non-inversion input terminal of the operational amplifier A2 is connected to the variable portion of the variable resistance VR2. Furthermore, the capacity C2 is connected to the output of the operational amplifier A2. This output outputs the L-level common voltage VCOML. The variable resistances VR1 and VR2 have both terminals thereof connected to the constant voltages Vref and GND.

As the common drive circuit according to the present invention is constituted to have only a simple switch, it is possible to make the circuit area small. Moreover, the common drive circuit according to the present invention applies to the gate of the switch TFT the voltage of which H level is higher than the common voltage VCOMH and L level is lower than the common voltage VCOML. Therefore, it is possible to make ON resistance of the switch TFT lower than in the case of applying the common voltages VCOMH and VCOML to the gate so as to make the gate width smaller.

Furthermore, even if a high voltage is applied to the gate of the switch TFT, the voltage difference between the drain and source is that between the common voltages VCOMH and VCOML, and so it is possible to adapt the gate length of the TFT to the voltage difference between the common voltages VCOMH and VCOML. Accordingly, the common drive circuit according to the present invention is allowed to make the gate width of the switch TFT shorter so as to make the circuit area smaller.

In the case where the gate driver is placed on the same substrate as the liquid crystal display, the common drive circuit according to the present invention is placed at the terminal opposite to the terminal at which the gate driver is placed so as to make the frame of the liquid crystal display symmetrical with a width nearly equal to that of the gate driver. Furthermore, the common drive circuit is placed close to the pad in the case where the common voltages VCOMH and VCOML are supplied from an input pad of the liquid crystal display, and the common drive circuit is placed close to the common voltage generating circuit in the case where the common voltage generating circuit is placed on the same substrate so that it is possible to curb a wiring load and shorten driving time of the common electrode by the common drive circuit.

As for the common voltage generating circuit according to the present invention, if the resistance from the variable portion of the variable resistance to the constant voltage Vref is RA1 and the resistance from the variable portion to the GND is RB1, and if the voltage of the variable resistance VR2 is V2, a voltage V1 of the variable portion of the variable resistance VR1 hardly depends on the resistances R11 and R12 and can be determined according to the values of the resistances RA1 and RB1 when a total resistance value (RA1+RA2) of the variable resistance VR1 is one third or less of the resistance R11.

If the resistance from the variable portion to the constant voltage Vref is RA2 and the resistance from the variable portion to the GND is RB2 as to the variable resistance VR2, a voltage V2 does not depend on the resistances R21 and R22 and can be determined according to the values of the resistances RA2 and RB2. Here, as the common voltage VCOMH depends on the voltages V1 and V2 and the common voltage VCOML only depends on the voltages V2, it is possible, in the common voltage generating circuit according to the present invention, to have a common voltage difference Vsw (=VCOMH−VCOML) adjusted only by the voltage V1, that is, the variable resistance VR1 and have the common voltage VCOML adjusted only by the variable resistance VR2.

In general, considering operating time and power consumption, the resistances R11, R12, R21 and R22 are several MQ or so whereas the resistance (RA2+RB2) is designed to be the same value or larger such as several MΩ to several 10MΩ. Therefore, the resistance (RA1+RB1) is one third or less of at least one of the other resistances [resistance (RA2+RB2) and resistances R11, R12, R21 and R22], and in many cases, one third or less of all the other resistances.

Furthermore, the common voltage generating circuit according to the present invention has the capacities C1 and C2 for the output. It is considered that, as these capacity values are sufficiently larger than all the common electrodes of the liquid crystal display, there is almost no influence of a voltage drop.

Furthermore, of the common voltage generating circuit, the capacities and resistances are provided to the outside of the liquid crystal display, the other portions of the common voltage generating circuit are integrated on the liquid crystal display, the common voltage generating circuit is placed close to the input pad of the liquid crystal display, and the common drive circuit is placed close to the common voltage generating circuit so that there is almost no influence of the wiring resistance and thus the common electrode driving time by the common drive circuit is not thereby influenced.

As described above, according to the present invention, the circuits are simple, and it is possible, by applying a voltage higher than that carried between the drain and source to the portion between the gate and source of the switch TFT used for the drive circuit, to reduce the ON resistance of the drive circuit and shorten the gate length so as to allow the circuit area to be reduced by decreasing the TFT gate width and the circuit area of the common drive circuit to be reduced.

According to the present invention, it is possible to implement the symmetrical frame by placing the common drive circuit at the terminal opposite to the terminal at which the gate driver is placed on the liquid crystal display. According to the present invention, it is also possible to avoid lowering of the drive capability of the common drive circuit due to the wiring resistance by placing it close to the pad in the case of supplying the common voltage from the pad and placing it close to the common voltage generating circuit in the case of supplying the common voltage from the common voltage generating circuit respectively. Furthermore, use of the common drive circuit according to the present invention allows the circuit area to be smaller and the frame to be narrower. Thus, according to the present invention, it is possible to implement the symmetrical frame and narrower frame without lowering the drive capability of the common drive circuit when placing the common drive circuit on the liquid crystal display substrate.

As for the common voltage generating circuit according to the present invention, a common voltage amplitude and the common voltage L level are independently adjustable with the variable resistance so that the common voltage level can be easily adjusted. The output of the common voltage generating circuit according to the present invention has the capacities sufficiently larger than the common electrode capacity values connected thereto, and so there arises little voltage variation when the common drive circuit drives the common electrode and highly accurate voltage can be applied. Furthermore, in the case of placing the common drive circuit and the common voltage generating circuit on the liquid crystal display substrate, the common drive circuit and the common voltage generating circuit are placed close together so that there is no influence of the wiring load and the drive capability of the common drive circuit is not lowered.

Thus, according to the present invention, it is possible, when placing the common drive circuit on the liquid crystal display substrate, to implement the common voltage generating circuit capable of easily adjusting a common voltage level without lowering the drive capability of the common drive circuit. Moreover, the present invention is applicable not only to the above liquid crystal display but also to an active matrix display unit having a large capacity load.

Embodiment

Next, embodiments of the present invention will be described by referring to the drawings. While the present invention will be described hereafter by using a liquid crystal display, the present invention is also applicable to an active matrix display unit which is more common.

FIG. 1 is a diagram showing a configuration of a liquid crystal display substrate according to a first embodiment of the present invention. In FIG. 1, a liquid crystal display substrate 10 has a liquid crystal display portion 1 having pixels placed like a matrix, a data driver circuit 2 for driving a data line of the liquid crystal display portion 1, a gate driver circuit 3 for controlling switching of the pixels of each line of the liquid crystal display portion 1, and a common drive circuit 4 for driving a common electrode opposed to a picture electrode of the liquid crystal display portion 1 by sandwiching a liquid crystal layer (simultaneously driving the common electrodes of all the pixels of the liquid crystal display) mounted thereon, and has a power circuit IC 5 for supplying a voltage to a driver circuit and a drive circuit provided to the outside thereof.

The liquid crystal display substrate 10 has the data driver circuit 2 and gate driver circuit 3 for driving the liquid crystal display integrated thereon together with the common drive circuit 4, where common voltages VCOMH and VCOML are applied from the outside through a pad.

The gate driver circuit 3 is placed to be adjacent to one of the four terminals of the liquid crystal display. The common drive circuit 4 is placed to be adjacent to the terminal opposite to where the gate driver circuit 3 is placed and as close to the pad as possible while having almost the same width as the area of the gate driver circuit 3. And the pad close to where the common drive circuit 4 is placed is used as the pad for applying the common voltages VCOMH and VCOML.

According to the embodiment, it is possible to have no wasteful area and make the frame symmetrical as the entire liquid crystal display including the gate driver circuit 3 and the common drive circuit 4. Furthermore, it is possible, by placing the common drive circuit 4 in the vicinity of the pad, to reduce influence of wiring resistance and curb delay in driving the common electrodes by the common drive circuit 4.

FIG. 2 is a diagram showing a first configuration example of the common drive circuit 4 in FIG. 1. In FIG. 2, the common drive circuit 4 is comprised of two common level power lines (VCOMH and VCOML), the common electrode in the liquid crystal display, a common inversion timing signal line COMD, a PchTFT (TFT: Thin Film Transistor) 41 and an NchTFT 42.

Of a drain and a source of the PchTFT 41, one terminal is connected to an H-level common voltage VCOMH power line and the other terminal is connected to the common electrode. Of the drain and source of the NchTFT 42, one terminal is connected to an L-level common voltage VCOML power line and the other terminal is connected to the common electrode.

The gates of the PchTFT 41 and NchTFT 42 are connected to the common inversion timing signal line COMD so as to make the H level of the COMD higher than the VCOMH and the L level of the COMD lower than the VCOML.

FIG. 3 is a timing chart showing operation of the common drive circuit 4 in FIG. 2. The operation of the common drive circuit 4 according to the first embodiment of the present invention will be described by referring to these FIGS. 2 and 3.

According to the embodiment, voltage difference between the gate and source of the PchTFT 41 and NchTFT 42 is larger compared to the voltages VCOMH and VCOML so that ON resistances of the PchTFT 41 and NchTFT 42 can be reduced.

As only the voltages VCOMH and VCOML are carried between the drain and source of the PchTFT 41 and NchTFT 42 so that the gate length of the PchTFT 41 and NchTFT 42 can be shortened according to two common level amplitudes.

The common drive circuit 4 according to the first embodiment of the present invention can have the gate width of the PchTFT 41 and NchTFT 42 made smaller as above and thereby reduce the circuit area.

FIG. 4 is a diagram showing a second configuration example of the common drive circuit 4 in FIG. 1. In FIG. 4, the common drive circuit 4 has the same configuration as the first configuration example of the common drive circuit 4 shown in FIG. 2 except that it has a common inversion timing signal buffer 44.

An input signal of common inversion timing may have drive capability of a substantially normal input signal. It is also possible to make the input signal of common inversion timing low-voltage-level by providing a level shift (LS) 43 just before the common inversion timing signal buffer 44.

Furthermore, according to this embodiment, a common inversion signal applied to the gates of the PchTFT 41 and NchTFT 42 can use power of the gate driver circuit 3 used for the liquid crystal display. In that case, there is an advantage that it is no longer necessary to newly prepare a voltage level for the common drive circuit.

FIG. 5 is a diagram showing a third configuration example of the common drive circuit 4 in FIG. 1. In FIG. 5, instead of the PchTFT 41 and NchTFT 42 in each of the above configuration examples, the common drive circuit 4 uses switches 45 and 46 of a CMOS (Complementary Metal Oxide Semiconductor) structure for combining the PchTFT and NchTFT as one switch and has a common inversion timing signal buffer 47.

In this case, the switches 45 and 46 are timing-controlled by the common inversion timing signal and inversion signal thereof, and so either the common inversion timing signal and inversion signal thereof are inputted from the outside or the inversion signal of the common inversion timing signal is generated from the common inversion timing signal through an inverter.

According to this embodiment, it is possible to curb the circuit area and make the frame narrower by adopting each of the above configuration examples as the common drive circuit 4. This embodiment is also applicable to the case where the data driver circuit 2 is not integrated on the liquid crystal display substrate 10 and the case where the other circuits are integrated thereon.

FIG. 6 is a diagram showing the configuration of the liquid crystal display substrate according to a second embodiment of the present invention. In FIG. 6, the liquid crystal display substrate 10 has the display portion 1, data driver circuit 2, gate driver circuit 3, common drive circuit 4 and a common voltage generating circuit 51 mounted thereon, and has a power circuit IC 52 excluding the common voltages for supplying the voltage to the driver circuit and drive circuit provided to the outside thereof.

The liquid crystal display substrate 10 has the data driver circuit 2 and gate driver circuit 3 for driving the liquid crystal display integrated thereon together with the common drive circuit 4 and common voltage generating circuit 51, where common voltages VCOMH and VCOML are applied from the outside through a pad.

The gate driver circuit 3 is placed to be adjacent to one of the four terminals of the liquid crystal display. The common voltage generating circuit 51 is placed to be adjacent to the pad at the terminal opposite to where the gate driver circuit 3 is placed. And the pad close to where the common voltage generating circuit 51 is placed is used as the pad to which the power, voltage, external resistance and external capacity used by the common drive circuit 4 are connected.

The common drive circuit 4 is placed to be adjacent to the terminal opposite to where the gate driver circuit 3 is placed while having almost the same width as the area of the gate driver circuit 3 and being adjacent to the common voltage generating circuit 51.

According to this embodiment, it is possible to have no wasteful area and make the frame symmetrical as the entire liquid crystal display including the gate driver circuit 3, common voltage generating circuit 51 and common drive circuit 4. In addition, it is possible according to this embodiment, by placing the common voltage generating circuit 51 close to the pad necessary for it and placing the common drive circuit 4 close to the common voltage generating circuit 51, to reduce influence of wiring resistance and curb the delay in driving the common electrode by the common drive circuit 4.

FIG. 7 is a diagram showing the configuration of the common voltage generating circuit 51 in FIG. 6. FIG. 7 shows the common drive circuit 4 and common voltage generating circuit 51, where each of the above configuration examples is adaptable as the configuration of the common drive circuit 4.

The common voltage generating circuit 51 is the circuit for generating the common voltages (VCOMH and VCOML), and is comprised of the variable resistance (VR1) for adjusting the voltage difference between the common voltages VCOMH and VCOML, the variable resistance (VR2) for adjusting the level of the VCOML, the four resistances (R11, R12, R21 and R22), the two operational amplifiers (A1 and A2) and two capacities (C1 and C2), and has adequate constant voltage (Vref) inputted thereto. However, a total resistance value of the variable resistance VR1 is one third or less compared to the resistance R11. And capacity values of the two capacities C1 and C2 are at least 100 times larger than a total of common electrode capacity values of the liquid crystal display.

An inversion input terminal of an operational amplifier A1 has the resistances R11 and R12 connected in parallel thereto, where the other terminal of the resistance R11 is connected to the variable portion of the variable resistance VR1 and the other terminal of the resistance R12 is connected to the output of the operational amplifier A1 respectively. A non-inversion input terminal of the operational amplifier A1 is connected to the variable portion of the variable resistance VR2. The capacity C1 is connected to the output of the operational amplifier A1. This output outputs the common voltage VCOMH.

The inversion input terminal of an operational amplifier A2 has the resistances R21 and R22 connected in parallel thereto, where the other terminal of the resistance R21 is connected to the constant voltage Vref and the other terminal of the resistance R22 is connected to the output of the operational amplifier A2 respectively. The non-inversion input terminal of the operational amplifier A2 is connected to the variable portion of the variable resistance VR2. The capacity C2 is connected to the output of the operational amplifier A2. This output outputs the common voltage VCOML. Both terminals of the variable resistances VR1 and VR2 are connected to the constant voltages Vref and GND.

If the resistance from the variable portion of the variable resistance VR1 to the constant voltage Vref is RA1, the resistance from the variable portion to the GND is RB1, and the voltage of the variable portion of the variable resistance VR2 is V2, the voltage V1 of the variable portion of the variable resistance VR1 in the common voltage generating circuit 51 according to this embodiment is represented as follows.

$$V1 = Vref \times R11 \times RB1 / (R11 \times RA1 + R11 \times RB1 + RA1 \times RB1) + V2 \times RA1 \times RB1 / (R11 \times RA1 + R11 \times RB1 + RA1 \times RB1) \quad (1)$$

If the total resistance value (RA1+RB1) of the variable resistance VR1 is one third or less of the resistance R11, the second term on the right side of the formula (I) can almost be ignored compared to the first term, and the third term in the denominator of the first term on the right side of the formula (I) can be ignored compared to the first and second terms, it is represented as follows.

$$V1 \leq Vref \times RB1/(RA1+RB1) \quad (2)$$

As for the variable resistance VR2, it is represented as follows if the resistance from the variable portion thereof to the constant voltage Vref is RA2, and the resistance from the variable portion to the GND is RB2.

$$V2 = Vref \times RB2/(RA2+RB2) \quad (3)$$

The common voltages VCOMH and VCOML are represented as follows.

$$VCOMH = V2 \times (R11 + R12)/R11 - V1 \times R12/R11 \quad (4)$$

$$VCOML = V2 \times (R21 + R22/R21 - Vref \times R22/R21) \quad (5)$$

Here, in the case where the resistance values of the resistances R11 and R21 are equal and the resistance values of the resistances R12 and R22 are equal, the common voltage difference Vsw (=VCOMH_VCOML) is represented as follows.

$$Vsw = (Vref - V1) \times R12/R11 \quad (6)$$

Therefore, as for the common voltage generating circuit 51 according to this embodiment, the common voltage difference Vsw can be adjusted only by the voltage V1, that is, the variable resistance VR1, and the common voltage VCOML can be adjusted only by the variable resistance VR2.

The common voltage generating circuit 51 according to this embodiment has the output equipped with the capacities C1 and C2. If the capacity values thereof are sufficiently larger than all the common electrodes of the liquid crystal display, the common voltage generating circuit 51 supposedly has almost no output resistance so that the driving time of the common drive circuit 4 will not be thereby influenced.

FIG. 8 is a diagram showing an example of combining the common voltage generating circuit 51 in FIG. 7 with the common drive circuit 4 in FIG. 4. The example shown in FIG. 8 is merely an example, and it is also possible to combine it with the common drive circuit of another method. While the voltages applied to both terminals of the variable resistances VR1 and VR2 are the constant voltages Vref and GND according to this embodiment, adequate constant voltages may be used for these voltages.

Thus, according to this embodiment, it is possible to curb the circuit area and make the frame narrower by adopting as the common drive circuit 4 each of the configuration examples of the first embodiment of the present invention shown in FIGS. 2, 4 and 5 respectively.

According to this embodiment, it is possible, by adopting the configuration example shown in FIG. 7 as the common voltage generating circuit 51 and connecting the resistances and capacities used therein to the outside of the liquid crystal display substrate through an input pad, to implement the liquid crystal display with no wasteful area but having the symmetrical frame and capable of easily adjusting the common voltage level, wherein the gate driver circuit 3, common drive circuit 4, and common voltage generating circuit 51 are integrated. Furthermore, this embodiment is also applicable to the case where the data driver circuit 2 is not integrated on the liquid crystal display substrate 10 and the case where the other circuits are integrated thereon.

Thus, according to the present invention, the circuits are simple, and it is possible, by applying a voltage higher than that carried between the drain and source to the portion between the gate and source of the switch TFT used for the common drive circuit 4, to reduce the ON resistance of the common drive circuit 4 and shorten the gate length. For this reason, the present invention allows the TFT gate width to be decreased and the circuit area to be reduced so that the circuit area of the common drive circuit 4 can be reduced.

According to the present invention, it is also possible to implement the symmetrical frame by placing the common drive circuit 4 at the terminal opposite to the terminal at which the gate driver 3 is placed on the liquid crystal display substrate 10. In this case, it is also possible, according to the present invention, to avoid lowering of the drive capability of the common drive circuit 4 due to the wiring resistance by placing it close to the pad in the case of supplying the common voltage from the pad and placing it close to the common voltage generating circuit 51 in the case of supplying the common voltage from the common voltage generating circuit 51.

Thus, according to the present invention, use of the common drive circuit 4 of the above configurations allows the circuit area to be smaller and the frame to be narrower. Therefore, it is possible, when placing the common drive circuit 4 on the liquid crystal display substrate 10, to implement the symmetrical frame and narrower frame without lowering the drive capability of the common drive circuit 4.

Furthermore, according to the present invention, the common voltage generating circuit 51 can adjust the common voltage amplitude and common voltage L level independently with the variable resistance so that adjustment of the common voltage level is easy. The output of the common voltage generating circuit 51 has the capacities sufficiently larger than the common electrode capacity values connected thereto, and so there arises little voltage variation when the common drive circuit 4 drives the common electrode and highly accurate voltage can be applied.

In the case of placing the common drive circuit 4 and the common voltage generating circuit 51 on the liquid crystal display substrate 10, the common drive circuit 4 and the common voltage generating circuit 51 are placed close together so that there is no influence of the wiring load and the drive capability of the common drive circuit 4 is not lowered. Thus, according to the present invention, it is possible, when placing the common drive circuit 4 on the liquid crystal display substrate 10, to implement the common voltage generating circuit 51 capable of easily adjusting a common voltage level without lowering the drive capability of the common drive circuit 4. Moreover, the present invention allows the same effects as those mentioned above as to an active matrix display unit which is more common by providing the same configuration as above.

Advantages of the Invention

As described above, the present invention allows the effect that it is possible, by placing the common drive circuit at the terminal opposite to the terminal at which the gate driver circuit is placed on the display substrate, to implement the symmetrical frame and narrower frame without lowering the drive capability of the common drive circuit.

DESCRIPTION OF SYMBOLS

Figure 1:
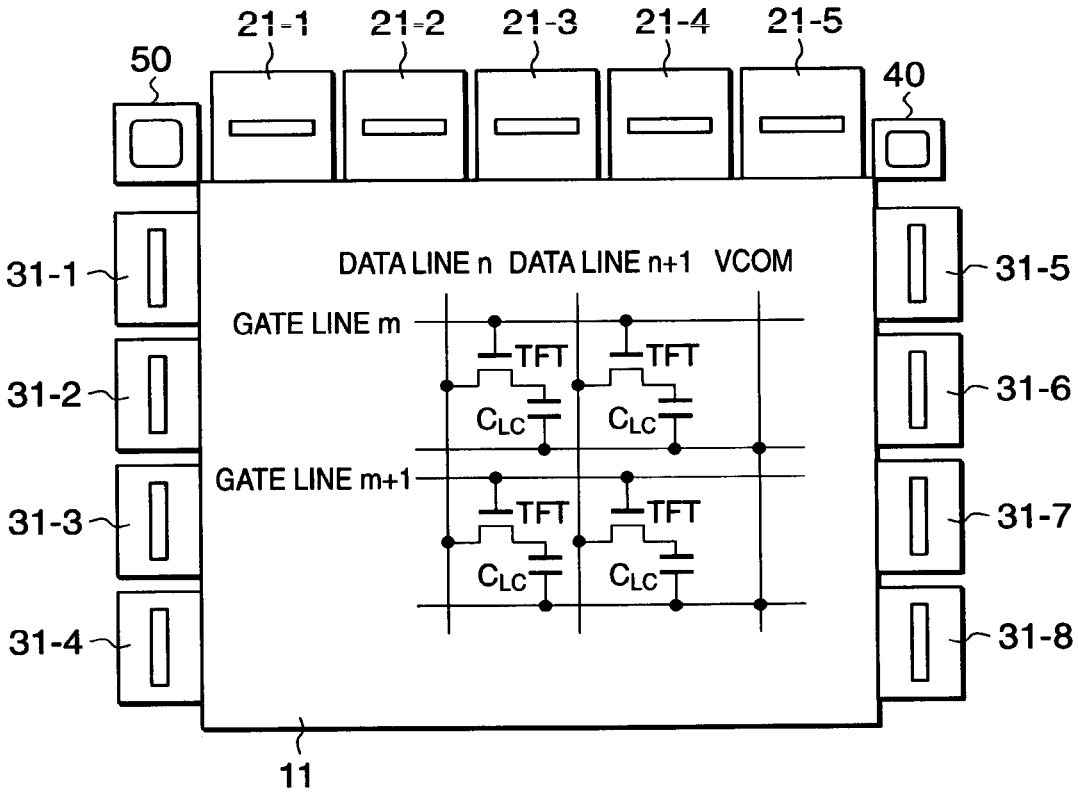
FIG.1 PRIOR ART
FIG. 1 is a diagram showing a configuration of a liquid crystal display substrate according to a first embodiment of the present invention.
Figure 2:
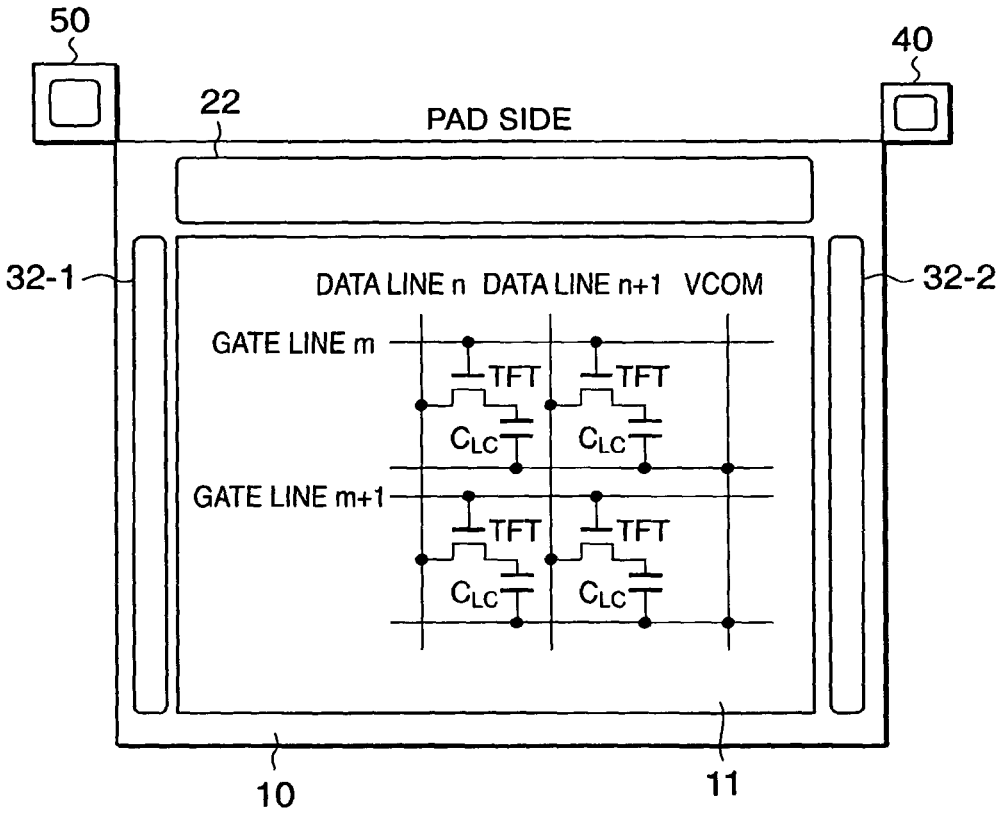
FIG.2 PRIOR ART
FIG. 2 is a diagram showing a first configuration example of a common drive circuit in FIG. 1.
Figure 3:
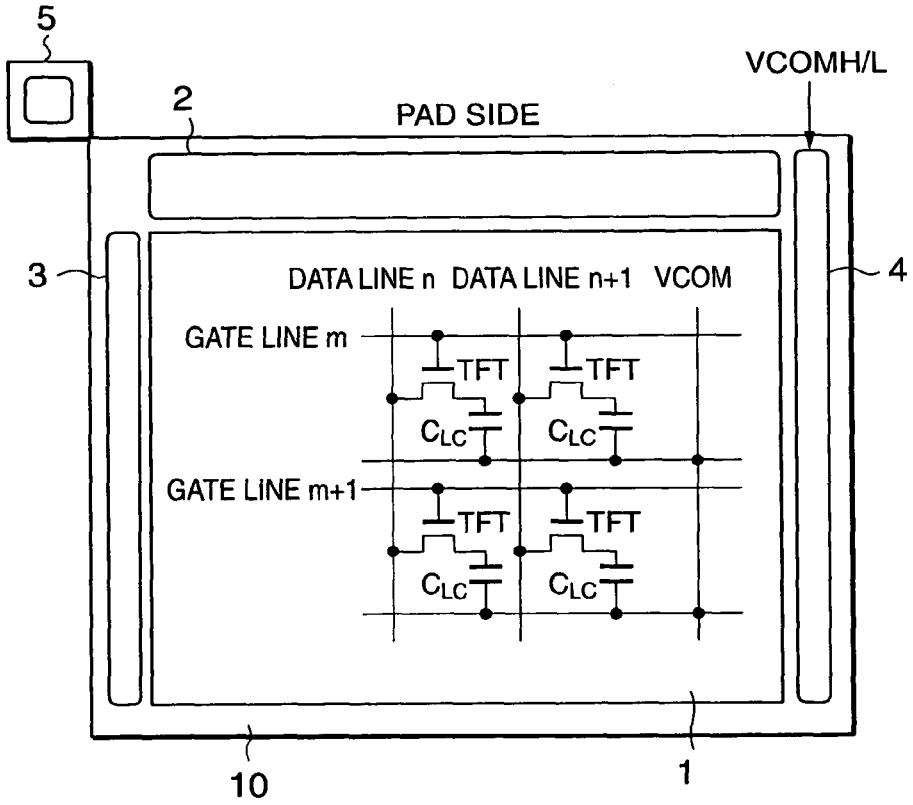
FIG. 3 is a timing chart showing operation of the common drive circuit in FIG. 2.
Figure 4:
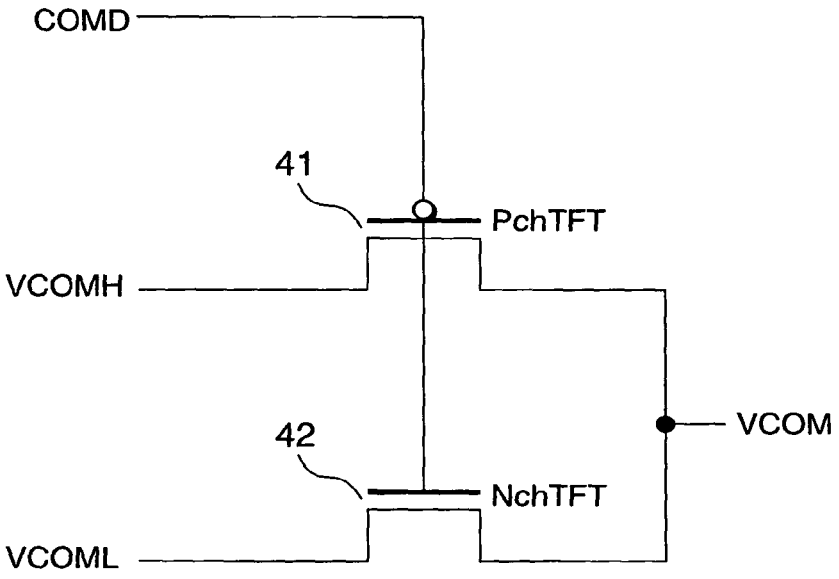
FIG. 4 is a diagram showing a second configuration example of the common drive circuit in FIG. 1.
Figure 5:
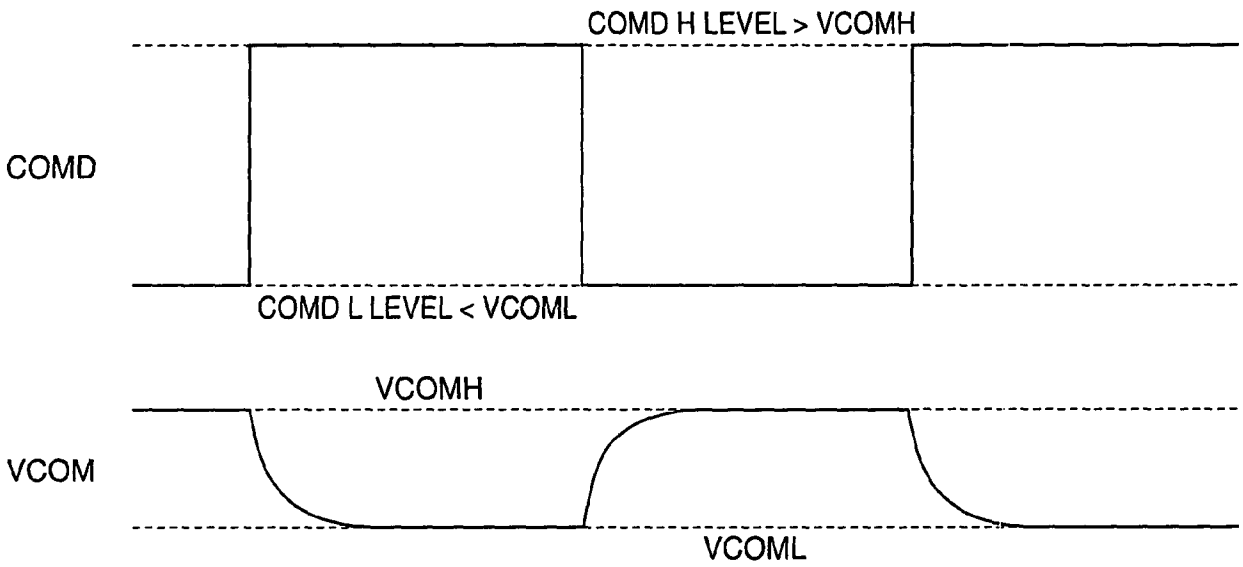
FIG. 5 is a diagram showing a third configuration example of the common drive circuit in FIG. 1.
Figure 6:
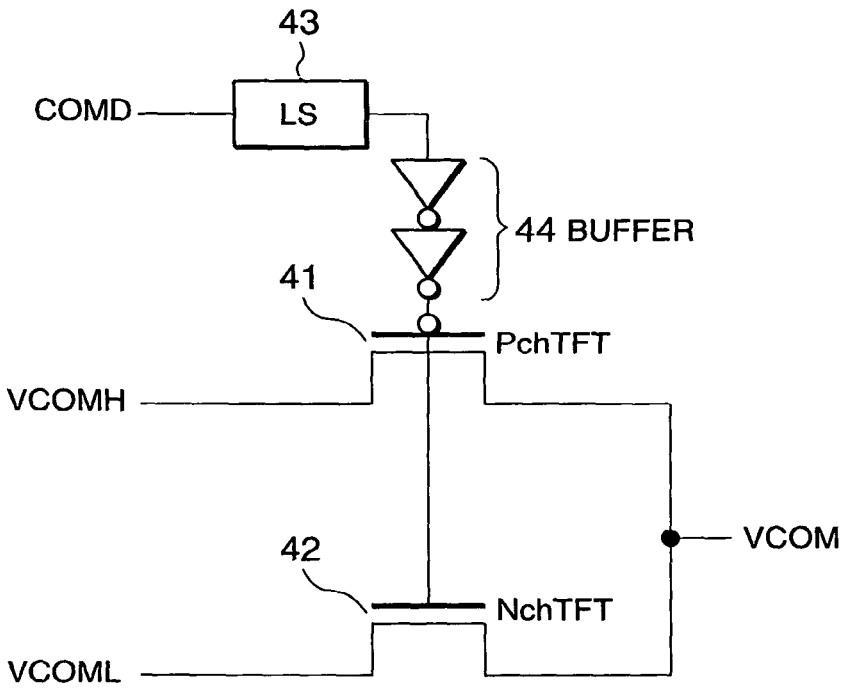
FIG. 6 is a diagram showing the configuration of the liquid crystal display substrate according to a second embodiment of the present invention.
Figure 7:
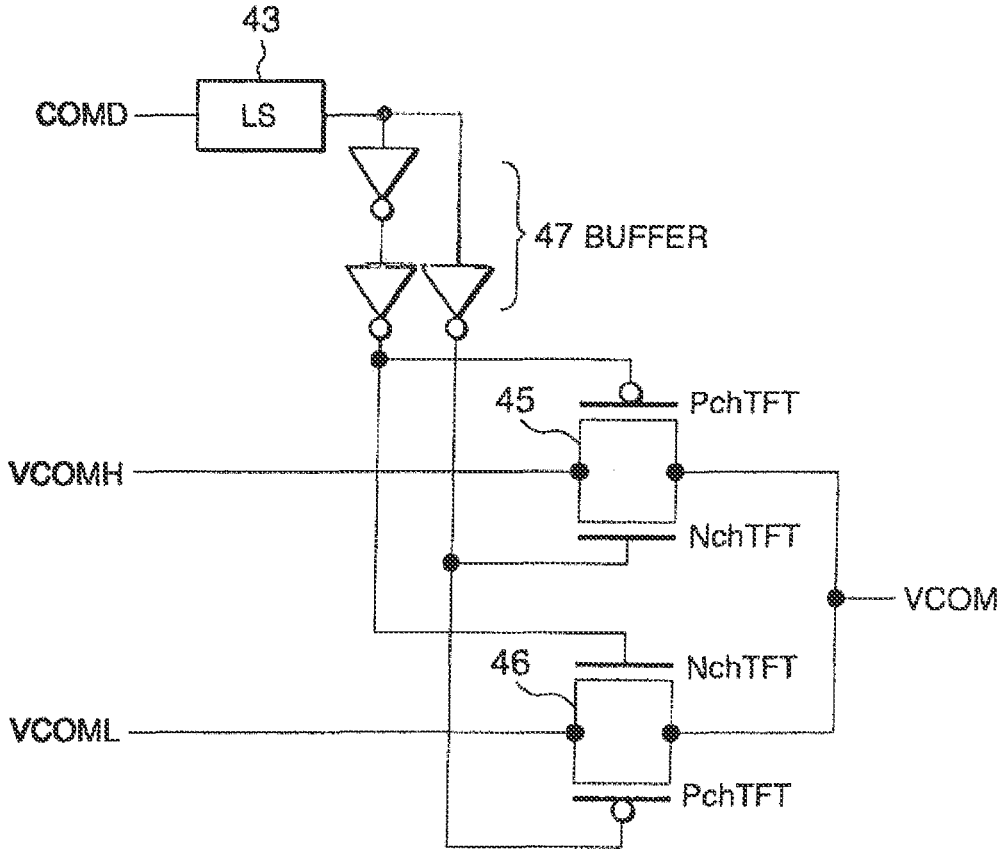
FIG. 7 is a diagram showing the configuration of a common voltage generating circuit in FIG. 6.
Figure 8:
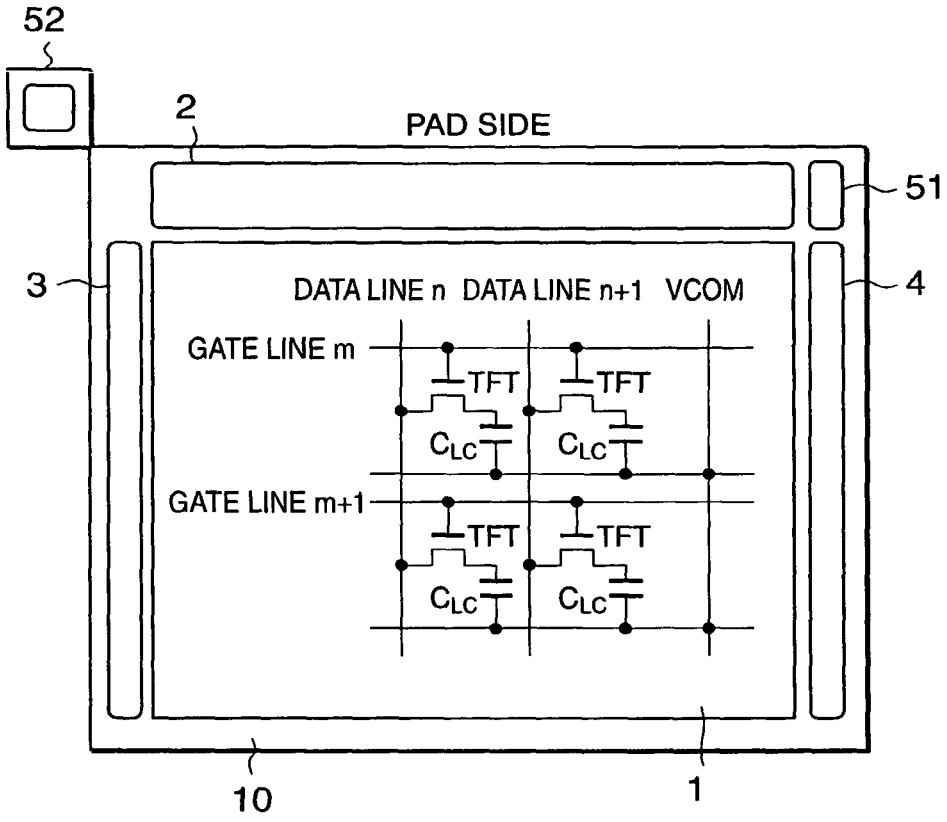
FIG. 8 is a diagram showing an example of combining the common voltage generating circuit in FIG. 7 with the common drive circuit in FIG. 4.
Figure 9:
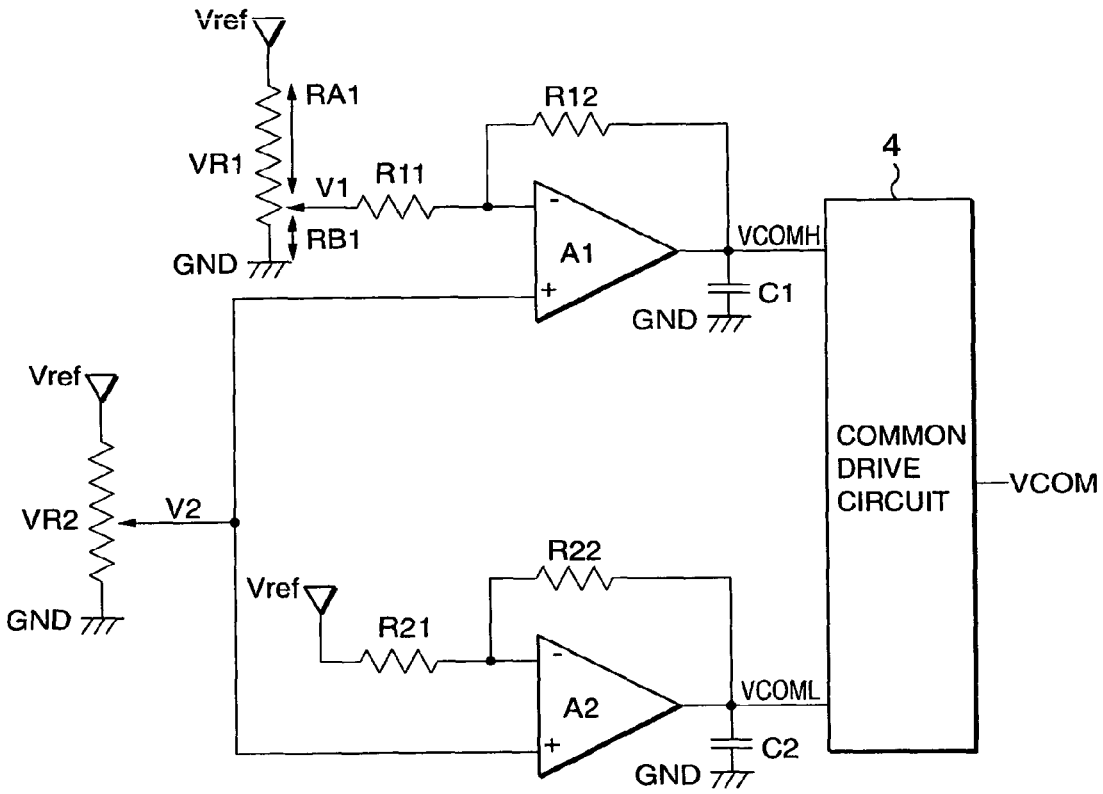
FIG. 9 is a diagram showing an example of a configuration of the conventional liquid crystal display.
Figure 10:
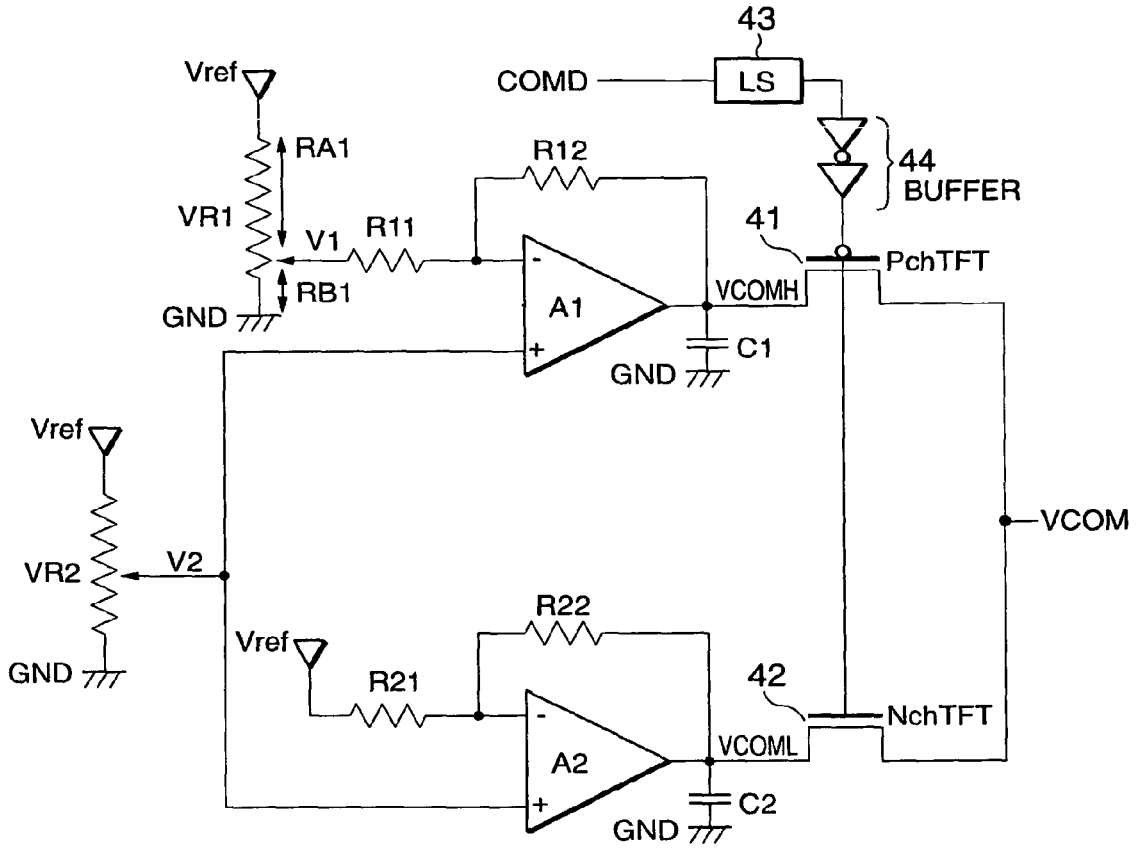
FIG. 10 is a diagram showing a configuration example of the liquid crystal display having the drivers in the past integrated therein.

1 . . . Display portion
2 . . . Data driver circuit
3 . . . Gate driver circuit
4 . . . Common drive circuit
5 . . . Power circuit IC
10 . . . Liquid crystal display substrate
41 . . . PchTFT
42 . . . NchTFT
43 . . . Level shift
44, 47 . . . Common inversion timing signal buffers
45, 46 . . . Switches
51 . . . Common voltage generating circuit
52 . . . Power circuit IC excluding the common voltages

What is claimed:

1. A voltage generating circuit for generating a providing voltage to a drive circuit comprising:

a first and a second variable resistances for adjusting said providing voltage;

a first operational amplifier outputting a high level of said providing voltage, and a non-inversion input thereof connected to a variable portion of said second variable resistance;

a second operational amplifier outputting a low level of said providing voltage, and a non-inversion input thereof connected to a variable portion of said second variable resistance;

a first resistance connecting a variable portion of said first variable resistances to an inversion input of said first operational amplifier;

a second resistance wherein one terminal of said second resistance connected to said inversion input of said first operational amplifier, and the other terminal of said second resistance connected to output of said first operational amplifier;

a third resistance connecting a constant voltage supply to an inversion input of said second operational amplifier;

a fourth resistance wherein one terminal of said fourth resistance connects to a inversion input of said second operational amplifier, and the other terminal of said fourth resistance connects to an output of said second operational amplifier;

wherein total resistance of said first variable resistance is a resistance value of one third or less of at least one of the total resistance of said second variable resistance and resistance of said first operational amplifier, said second operational amplifier, said first resistance, said second resistance, said third resistance, and said fourth resistance; and wherein said first and second variable resistances adjust a low level of said providing voltage and a voltage difference between a high level and the low level of said providing voltage.

2. The voltage generating circuit according to claim 1, wherein said voltage generating circuit, a display portion, a drive circuit, a gate driver circuit for controlling switching of pixels of each line in said display portion are mounted on a substrate and wherein said voltage generating circuit and said driving circuit are disposed on a position of said substrate opposite to said gate driver circuit, and said display portion is disposed between said driving circuit and said gate driver circuit.

3. A voltage generating circuit for generating a providing voltage to a drive circuit comprising:

a first and a second variable resistances for adjusting said providing voltage;

a first operational amplifier outputting a high level of said providing voltage, and a non-inversion input thereof connected to a variable portion of said second variable resistance;

a second operational amplifier outputting a low level of said providing voltage, and a non-inversion input thereof connected to a variable portion of said second variable resistance;

a first resistance connecting a variable portion of said first variable resistances to an inversion input of said first operational amplifier;

a second resistance wherein one terminal of said second resistance connected to said inversion input of said first operational amplifier, and the other terminal of said second resistance connected to output of said first operational amplifier;

a first capacitance, wherein one terminal of said first capacitance is connected to said output of said first operational amplifier, and the other terminal of said first capacitance connected to a constant voltage;

a third resistance connecting a constant voltage supply to an inversion input of said second operational amplifier;

a fourth resistance wherein one terminal of said fourth resistance connects to a inversion input of said second operational amplifier, and the other terminal of said fourth resistance connects to an output of said second operational amplifier;

a second capacitance, wherein one terminal of said second capacitance is connected to said output of said second operational amplifier, and the other terminal of said second capacitance connected to the constant voltage, wherein total resistance of said first variable resistance is one third or less of at least one of the total resistance values of said second variable resistance and resistance of said first operational amplifier, said second operational amplifier, said first resistance, said second resistance, said third resistance, and said fourth resistance.

4. The voltage generating circuit according to claim 3, wherein said voltage generating circuit, a display portion, said drive circuit, and a gate driver circuit for controlling switching of pixels of each line in a display portion are mounted on a substrate, and wherein said voltage generating circuit and said driving circuit are disposed on a position of said substrate opposite to said gate driver circuit, and said display portion is disposed between said driving circuit and said gate driver circuit.

5. The voltage generating circuit according to claim 2, wherein at least one of said resistances and said capacitances are disposed outside said substrate, and are connected through an input pad of said display portion.

6. The voltage generating circuit according to claim 4, wherein at least one of said resistances and said capacitances are disposed outside said substrate, and are connected through an input pad of said display portion.

7. The voltage generating circuit according to claim 2, wherein said drive circuit comprises a drive circuit comprising; a first voltage supply, a second voltage supply for providing a voltage that is lower than a voltage of said first voltage supply, at least one first transistor including either a drain or a source terminal connected to said first voltage supply, at least one second transistor including either a drain or source terminal connected to said second voltage supply, at least one signal line connected to each gate terminal of said first and second transistor, and at least one capacitance load connected to respective terminals of said first and said second transistors not connected to said first and second voltage supplies, wherein said signal line conveys signals having a high level that is substantially the same or higher than the voltage of said first voltage supply and having a low level that is substantially same or lower than the voltage of said second voltage supply.

8. The voltage generating circuit according to claim 4 wherein said drive circuit comprises a drive circuit comprising; a first voltage supply, a second voltage supply for providing a voltage that is lower than a voltage of said first voltage supply, at least one first transistor including either a drain or k source terminal connected to said first voltage supply, at least one second transistor including either a drain or source terminal connected to said second voltage supply, at least one signal line connected to each gate terminal of said first and second transistor, and at least one capacitance load connected to respective terminals of said first and said second transistors not connected to said first and second voltage supplies, wherein said signal line conveys signals having a high level that is substantially the same or higher than the voltage of said first voltage supply and having a low level that is substantially the same or lower than the voltage of said second voltage supply.

9. A display comprising:

a substrate;

a display portion integrated on said substrate;

a gate driver circuit for controlling switching of pixels of each line in said display portion;

a common drive circuit for said display portion for simultaneously driving capacitive loads in said display portion; and a common voltage generating circuit for generating a providing voltage to said common drive circuit, wherein said common voltage generating circuit and said common drive circuit are disposed at a position of said substrate opposite to said gate driver circuit, and said display portion is disposed between said common drive circuit and said gate driver circuit, a first and a second variable resistances for adjusting said providing voltage, a first operational amplifier outputting a high level of said providing voltage, and a non-inversion input thereof connected to a variable portion of said second variable resistance, a second operational amplifier outputting a low level of said providing voltage, and a non-inversion input thereof connected to a variable portion of said second variable resistance, a first resistance connecting a variable portion of said first variable resistances to an inversion input of said first operational amplifier, a second resistance wherein one terminal of said second resistance connected to said inversion input of said first operational amplifier, and the other terminal of said second resistance connected to output of said first operational amplifier, a third resistance connecting a constant voltage supply to an inversion input of said second operational amplifier, and a fourth resistance wherein one terminal of said fourth resistance connects to a inversion input of said second operational amplifier, and the other terminal of said fourth resistance connects to an output of said second operational amplifier, wherein total resistance of said first variable resistance is a resistance value of one third or less of at least one of the total resistance of said second variable resistance and resistance of said first operational amplifier, said second operational amplifier, said first resistance, said second resistance, said third resistance, and said fourth resistance; and wherein said first and second variable resistances adjust a low level of said providing voltage and a voltage difference between a high level and the low level of said providing voltage.

10. A display comprising:

a substrate;

a display portion integrated on said substrate;

a gate driver circuit for controlling switching of pixels of each line in said display portion;

a common drive circuit for said display portion for simultaneously driving capacitive loads in said display portion; and a common voltage generating circuit for generating a providing voltage to said common drive circuit, wherein said common voltage generating circuit and said common drive circuit are disposed at a position of said substrate opposite to said gate driver circuit, and said display portion is disposed between said common drive circuit and said gate driver circuit, wherein said common voltage generating circuit comprises:

a first and a second variable resistances for adjusting said providing voltage;

a first operational amplifier outputting a high level of said providing voltage, and a non-inversion input thereof connected to a variable portion of said second variable resistance;

a second operational amplifier outputting a low level of said providing voltage, and a non-inversion input thereof connected to a variable portion of said second variable resistance;

a first resistance connecting a variable portion of said first variable resistances to an inversion input of said first operational amplifier;

a second resistance wherein one terminal of said second resistance connected to said inversion input of said first operational amplifier, and the other terminal thereof connected to output of said first operational amplifier;

a first capacitance connected to said output of said first operational amplifier, and the other terminal thereof connected to a constant voltage;

a third resistance connecting a constant voltage supply to an inversion input of said second operational amplifier;

a fourth resistance wherein one terminal thereof connects to a inversion input of said second operational amplifier, and the other terminal thereof connects to an output of said second operational amplifier;

a second capacitance wherein one terminal thereof connected to said output of said second operational amplifier, and the other terminal thereof connected to the constant voltage, wherein total resistance of said first variable resistance is one third or less of other resistance values.

11. The display according to claim 9, wherein said common drive circuit comprises a drive circuit comprising a first voltage supply, a second voltage supply for providing a voltage that is lower than a voltage of said first voltage supply, at least one first transistor including either a drain or a source terminal connected to said first voltage supply, at least one second transistor including either a drain or source terminal connected to said second voltage supply, at least one signal line connected to each gate terminal of said first and second transistor, and at least one capacitance load connected to respective terminals of said first and said second transistors not connected to said first and second voltage supplies, wherein said signal line conveys signals having a high level that is substantially the same or higher than the voltage of said first voltage supply and having a low level that is substantially the same or lower than the voltage of said second voltage supply.

12. The display according to claim 10, wherein said common drive circuit comprises a drive circuit comprising a first voltage supply, a second voltage supply for providing a voltage that is lower than a voltage of said first voltage supply, at least one first transistor including either a drain or a source terminal connected to said first voltage supply, at least one second transistor including either a drain or source terminal connected to said second voltage supply, at least one signal line connected to each gate terminal of said first and second transistor, and at least one capacitance load connected to respective terminals of said first and said second transistors not connected to said first and second voltage supplies, wherein said signal line conveys signals having a high level that is substantially the same or higher than the voltage of said first voltage supply and having a low level that is substantially the same or lower than the voltage of said second voltage supply.

* * * * *